US008016129B2

(12) United States Patent
Peterson

(10) Patent No.: US 8,016,129 B2
(45) Date of Patent: Sep. 13, 2011

(54) TOOTHBRUSH STAND

(76) Inventor: Donna A. Peterson, Fairfax, VA (US)

( * ) Notice: Subject to any disclaimer, the term of this patent is extended or adjusted under 35 U.S.C. 154(b) by 409 days.

(21) Appl. No.: 12/285,888

(22) Filed: Oct. 15, 2008

(65) Prior Publication Data

US 2009/0107935 A1 Apr. 30, 2009

Related U.S. Application Data

(60) Provisional application No. 60/960,780, filed on Oct. 15, 2007.

(51) Int. Cl.
*A47B 81/02* (2006.01)

(52) U.S. Cl. ..... 211/65

(58) Field of Classification Search ..... 211/65, 211/66; D6/534; 15/247, 268, 171, 175; 206/361, 362, 362.2, 362.3, 15.2, 15.3
See application file for complete search history.

(56) References Cited

U.S. PATENT DOCUMENTS

| | | | | | |
|---|---|---|---|---|---|
| 1,553,648 | A | * | 9/1925 | Thompson | 206/362.2 |
| 1,584,261 | A | | 5/1926 | Vuolo | |
| 2,987,194 | A | * | 6/1961 | Burge | 211/65 |
| 3,132,653 | A | * | 5/1964 | Gazdik | 206/15.2 |
| 4,325,485 | A | | 4/1982 | Pina et al. | |
| 4,396,238 | A | * | 8/1983 | Torruella | 312/206 |
| D278,778 | S | * | 5/1985 | Brown | D6/534 |
| 4,607,752 | A | * | 8/1986 | Sherrow | 211/65 |
| 4,961,717 | A | * | 10/1990 | Hickey | 446/76 |
| 4,995,509 | A | * | 2/1991 | Kornfeind | 206/209.1 |
| D323,090 | S | | 1/1992 | Santarelli et al. | |
| 5,301,821 | A | * | 4/1994 | Jeannet et al. | 211/65 |
| 5,480,038 | A | * | 1/1996 | Collier | 211/65 |
| 5,769,245 | A | * | 6/1998 | Butler | 211/65 |
| 5,779,046 | A | * | 7/1998 | Plakos | 206/362.3 |
| 6,102,203 | A | * | 8/2000 | Marro | 206/362.1 |
| 6,135,279 | A | * | 10/2000 | Dryer | 206/362.1 |
| 6,186,324 | B1 | * | 2/2001 | Catterson | 206/362.1 |
| 6,253,931 | B1 | * | 7/2001 | Starkey | 211/65 |
| D477,734 | S | * | 7/2003 | Snell | D6/534 |
| D499,918 | S | | 12/2004 | Snell | |
| 6,935,515 | B1 | * | 8/2005 | Sookoo | 211/65 |
| 7,044,299 | B2 | * | 5/2006 | Nagoya | 206/361 |
| 7,152,739 | B1 | * | 12/2006 | Burleson | 206/581 |
| D546,607 | S | | 7/2007 | Dretzka | |
| 7,416,080 | B1 | * | 8/2008 | Langer | 206/361 |
| 2003/0070998 | A1 | * | 4/2003 | Bulka | 211/66 |
| 2007/0084810 | A1 | | 4/2007 | Morris et al. | |
| 2007/0114891 | A1 | * | 5/2007 | Kim | 312/207 |
| 2009/0107935 | A1 | * | 4/2009 | Peterson | 211/65 |
| 2009/0200184 | A1 | * | 8/2009 | Cullen | 206/362.2 |

* cited by examiner

*Primary Examiner* — Jennifer E. Novosad
(74) *Attorney, Agent, or Firm* — Welsh Flaxman & Gitler LLC

(57) ABSTRACT

A toothbrush stand having a base with a recess to support a distal handle end of a toothbrush thereon, an upright support post extending from the base for leaning at least one toothbrush there-against near a head end of the toothbrush when the distal handle end is supported on the base and an umbrella-like sheltering member adapted to cover a head of the toothbrush when the distal handle end of the toothbrush is supported on the base and the toothbrush is leaning against the support post. The sheltering member formed from at least four quadrants of individual compartments forming nodes that slide up and down with respect to one another.

14 Claims, 4 Drawing Sheets

TOOTHBRUSH STAND

CROSS REFERENCE TO RELATED APPLICATIONS

This application claims the benefit of U.S. Provisional Patent Application Ser. No. 60/960,780, entitled "Toothbrush Stand", filed Oct. 15, 2007.

BACKGROUND OF THE INVENTION

1. Field of the Invention

The present invention relates to a toothbrush stand capable of accommodating all sized brushes, including battery-operated designs. More particularly, the present invention relates to a toothbrush stand providing a support for toothbrushes in an upright position while preventing cross-contamination from brush-to-brush by providing an umbrella-like sheltering toothbrush cover divided into at least four quadrants of individual compartments (or nodes) configured in such a way that the brushes do not touch the interior of the compartments while stored within the toothbrush stand. Also, the umbrella-like sheltering toothbrush cover lifts for easy loading/unloading of brushes, and more importantly, enables the users to fully view the toothbrush and the toothbrush stand when placing/removing their toothbrush upon/from the toothbrush stand to avoid touching any surface of the stand with the bristles of the toothbrush.

2. Description of the Related Art

Conventional toothbrush holders leave the bristles of the toothbrush unprotected, where they can become contaminated with hair spray, antiperspirants, air fresheners, surface cleaners, splashed soap and water, and other common bathroom contaminants.

Attempts have been made in the prior art to solve this problem. U.S. Pat. No. D323,190 to Santarelli et al. discloses an ornamental design for a toothbrush holder which completely encloses the entire toothbrush. Although Santarelli et al. may protect the toothbrush from contaminants, the holder would hinder drying of the bristles because it completely encloses the toothbrush.

U.S. Pat. No. D278,778 to Brown discloses an ornamental design for a toothbrush holder which protects the bristles from contaminants by utilizing a dome adapted to cover the tops of the toothbrushes, including the bristles. The dome is connected to a toothbrush support plate having apertures therethrough to support toothbrushes by hanging the toothbrushes from their heads. This method of securing the toothbrush within the holder limits the size, style and shape of toothbrushes that can be used with the holder, thereby ruling out the support of the battery-operated toothbrushes that are commonly larger than conventional toothbrushes.

Accordingly, there is needed for a toothbrush holder which protects the bristles of the toothbrush from contaminants, does not hinder drying of the bristles, and which can be used with toothbrushes of a variety of sizes, styles and shapes.

SUMMARY OF THE INVENTION

Exemplary embodiments of the present invention address at least the above problems and/or disadvantages and provide at least the advantages described below. Accordingly, an aspect of exemplary embodiments of the present invention is to provide a toothbrush stand for providing a support for toothbrushes in an upright position while preventing cross-contamination from brush-to-brush interaction by providing an umbrella-like sheltering toothbrush cover that has individual compartments configured in such a way that the brushes do not touch the interior of the compartments while resting.

It is another object of the present invention to provide an umbrella-like toothbrush sheltering toothbrush cover that has individual compartment that help prevent cross-contamination from brush-to-brush interaction.

According to one aspect of an exemplary embodiment of the present invention, there is provided an umbrella-like sheltering toothbrush cover that lifts for easy loading/unloading of brushes.

According to another aspect of an exemplary embodiment of the present invention, there is provided an umbrella-like sheltering toothbrush cover that lifts and enables the users to fully see the toothbrush and toothbrush holder when placing/removing their toothbrush within/from the toothbrush holder to avoid touching any surface of the toothbrush.

According to a further aspect of an exemplary embodiment of the present invention, there is provided an umbrella-like sheltering toothbrush cover that is easily lifted by a one-handed, one-action movement.

It is another object of the present invention to provide an umbrella-like sheltering toothbrush cover that is sculpted for easy gripping and an aesthetically pleasing visual appeal.

According to one aspect of an exemplary embodiment of the present invention, there is provided an umbrella-like sheltering toothbrush cover wherein the interior of each individual compartment is rounded for easy cleaning and evaporation and also for keeping water/germs/bacteria from collecting.

According to another aspect of an exemplary embodiment of the present invention, there is provided an umbrella-like sheltering toothbrush cover that is designed in such a way that the toothbrushes do not touch the interior of compartment while resting so as to aid in the prevention of contamination from interaction between the toothbrushes and the umbrella-like sheltering toothbrush cover.

According to a further aspect of an exemplary embodiment of the present invention, there is provided an umbrella-like sheltering toothbrush cover wherein the toothbrush stand accommodates all sizes and types of toothbrushes, including battery-operated designs.

It is another object of the present invention to provide an umbrella-like sheltering toothbrush cover that has a center support that is 2 inches smaller so as to be sized for children sized toothbrushes.

Other objects, advantages, and salient features of the present invention will become apparent to those skilled in the art from the following detailed description, which, taken in conjunction with the annexed drawings, discloses exemplary embodiments of the invention.

DETAILED DESCRIPTION OF THE DRAWINGS

The above and other objects, features and advantages of certain exemplary embodiments of the present invention will be more apparent from the following detailed description when taken in conjunction with the accompanying drawings, in which.

Throughout the drawings, the same drawing reference numerals will be understood to refer to the same elements, features and structures.

DETAILED DESCRIPTION OF EXEMPLARY EMBODIMENTS

The matters exemplified in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

An apparatus of the present invention will be described hereinafter which provides a support for toothbrushes in an upright position while preventing cross-contamination from brush-to-brush interaction by providing an umbrella-like sheltering toothbrush cover that has individual compartment (or nodes) configured in such a way that the toothbrushes do not touch the interior of the compartments while resting.

Figure 1:
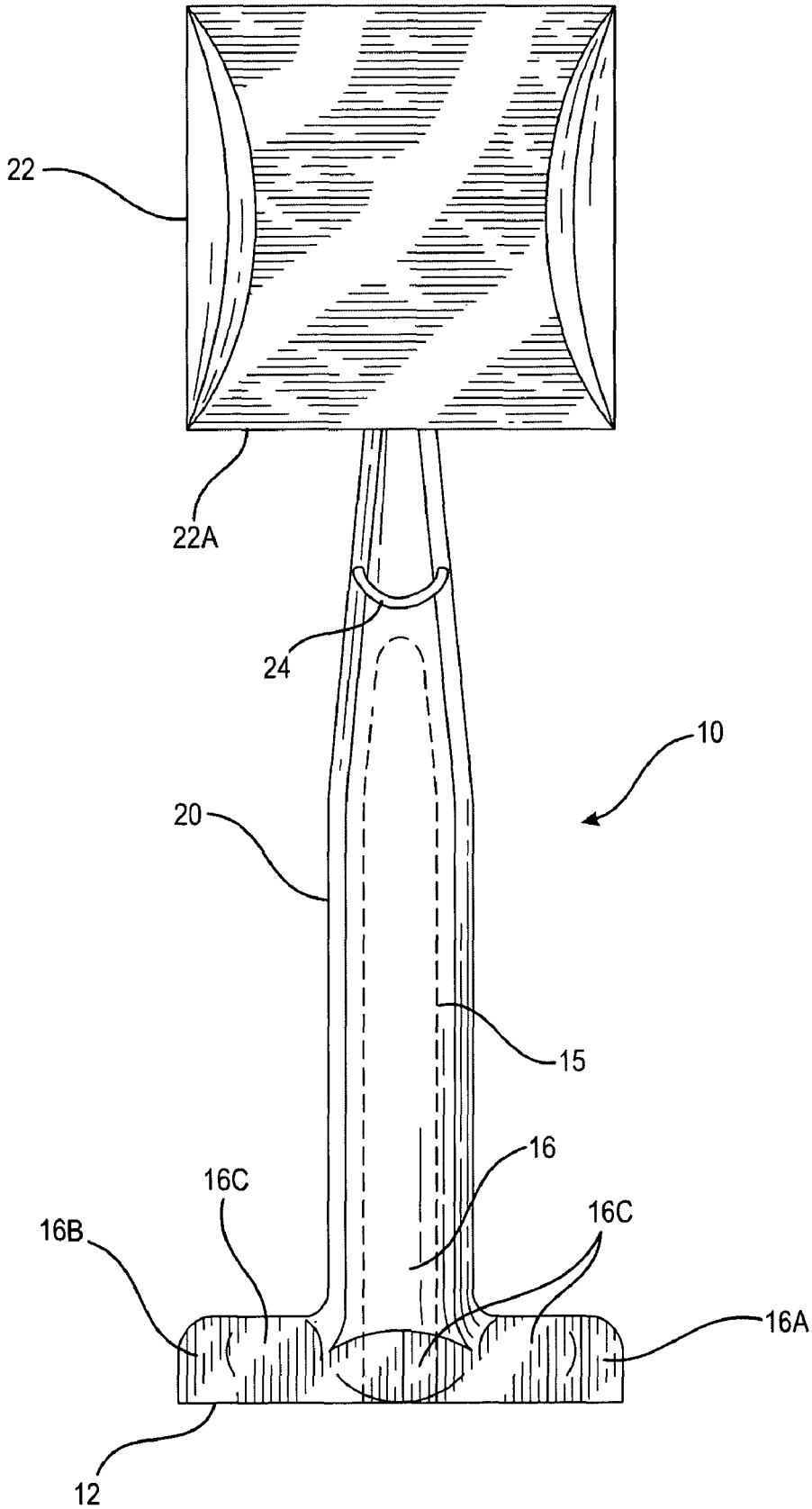
FIG. 1 is a front view of a toothbrush stand.
Figure 3:
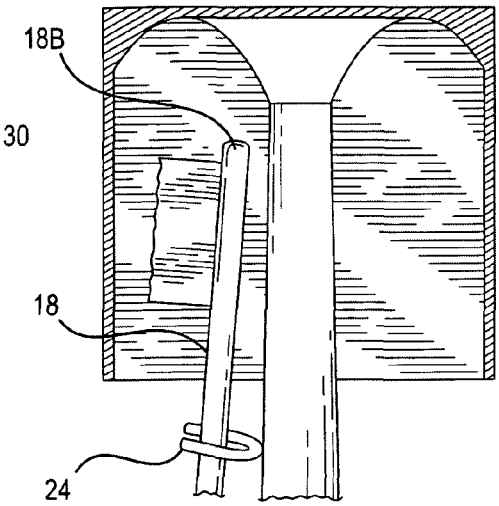
FIG. 3 is a cross-sectional view of the interior of the umbrella-like sheltering toothbrush cover as shown with reference to the embodiment of FIG. 1.

FIG. 1 is a front view of a toothbrush stand 10 in accordance with a first embodiment of the present invention. FIG. 3 is a side view of the interior of individual compartment of a toothbrush cover employed in accordance with the embodiment shown with reference to FIG. 1. Referring to FIGS. 1 and 3, the toothbrush stand 10 includes a base 12 adapted to rest on a flat horizontal surface (not shown), such as a sink or counter top. A distal handle end support member 16 for supporting a distal handle end of a toothbrush 18 is configured to rotate, or remain fixed, relative to the central member of the base 12. An elongated upright support member 20 extends outward from the distal handle end support member 16 and is fixedly connected to the distal handle end support member 16. An umbrella-like sheltering toothbrush cover (or dome) 22 is connected to a distal end (not shown) of the elongated upright support member 20 and has an open mouth 22A which is completely uncovered and faces the base 12. A resting member 24 is positioned about the elongated upright support member 20 for leaning the toothbrush 18 there against near a head end 18B of the toothbrush 18 when the distal handle end (not shown) is supported on the distal handle end support member 16. The toothbrush cover (or dome) 22 is positioned to cover the head end 18B of the toothbrush 18 when the distal handle end (not shown) is supported on the distal handle end support member 16 and the toothbrush 18 is leaning against the resting member 24. The resting member 24 is about an inch lower than that found in conjunction with a conventional toothbrush stand, so the bristles of the toothbrush won't touch the interior surface of the resting member 24. It should be clear that exemplary embodiments of the present invention may also be employed in a travel size or child size toothbrush stand.

The distal handle end support member 16 comprises a sleeve 16A circumferentially disposed about a central member 15 shown in dotted lines. A substantially planar, circular top member 16B is connected to the elongated upright support member 20 and extends outward to and connects with the sleeve 16A. The top member 16B includes top member depressions 16C therein adapted to support the distal handle end of the toothbrush 18 therein. The sleeve 16A includes a circular rim (not shown) which is notched to receive the central member 15 therein. Thus, the toothbrush stand 10 of the present invention permits a user to rotate a toothbrush 18 into a desired position by rotating the distal handle end support member 16 relative to the central member 15.

It is contemplated other configurations of the base 12 to permit rotation of the toothbrushes 18 into position are within the scope of the present invention. Alternatively, it is contemplated the base 12 may be constructed so as to be non-rotatable, with the associated disadvantage of not being able to easily rotate a toothbrush 18 into any desired position.

Figure 2:
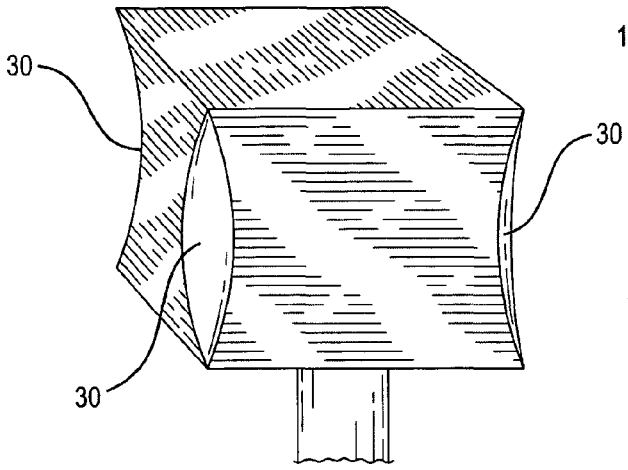
FIG. 2 is a detailed perspective view of the overhead cutouts of a toothbrush cover as shown with reference to the embodiment of FIG. 1.

FIG. 2 is a perspective view of the overhead cut-outs 30 of a toothbrush cover 22 in accordance with the embodiment shown with reference to FIG. 1. FIG. 2 shows an umbrella-like sheltering toothbrush cover 22 that is sculpted for easy gripping by those using the present toothbrush stand and an aesthetically desirable visual appearance. In accordance with preferred embodiment, the cut-outs 30 as shown in FIG. 2 are curved recesses thereby easing gripping by those using the present toothbrush stand and allow for a one-handed, one-action movement. Furthermore, it should be noted that the toothbrush stand 10 comprising the umbrella-like sheltering toothbrush cover 22 with individual compartments is opaque to prevent the toothbrushes from showing.

Figure 4:
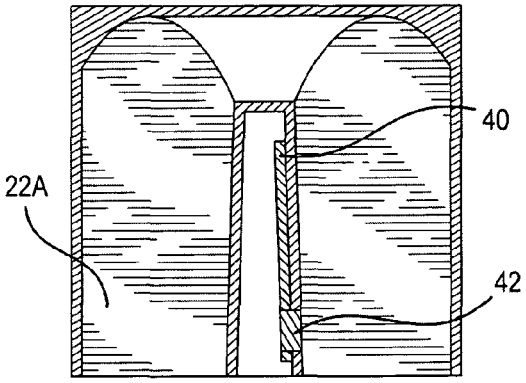
FIG. 4 is a cross sectional view showing a slot in the main support and a tab in a toothbrush cover allowing the toothbrush cover to lift and remain attached to the main support according to an exemplary embodiment of the present invention.

FIG. 4 is a cross sectional view showing a slot 40 in the elongated upright support member 20 and a tab 42 in the toothbrush cover 22 to allow the toothbrush cover 22 to be lifted by a user of the present toothbrush stand 10 while and remaining attached thereto. The concave slot (or groove) 40 shown in FIG. 4 eases lifting of the umbrella-like sheltering toothbrush cover 22.

Figure 5:
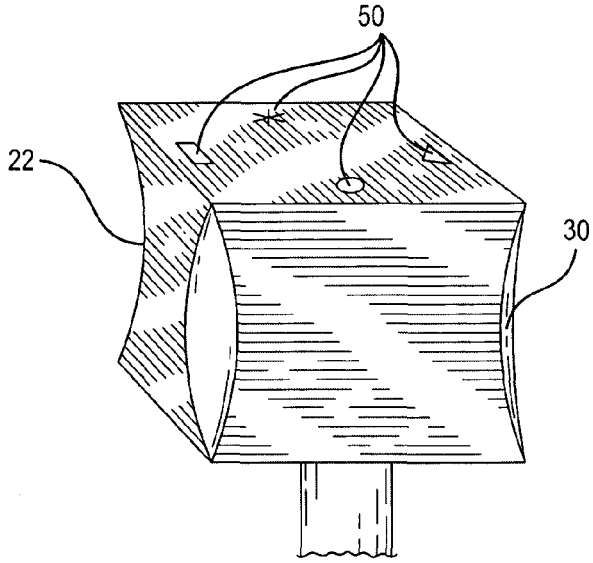
FIGS. 5 and 5A are top perspective views showing raised or indented areas (symbols or numbers) which denotes each compartment thereby keeping consistent use of the compartment for adults and children, and also helps sight-disabled people.
Figure 5A:
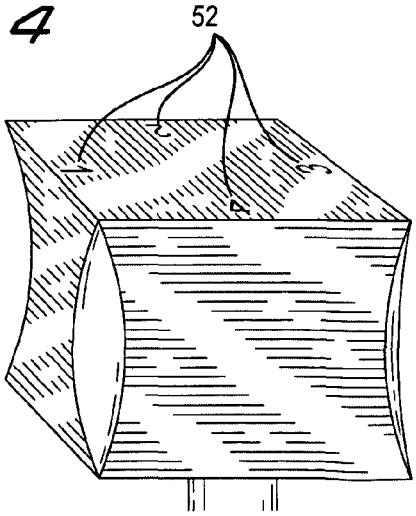

In accordance with alternate embodiments as shown with reference to FIGS. 5 and 5A, the umbrella-like toothbrush cover is provided with raised or indented symbols 50 or numbers 52. The symbols 50 and number 52 are formed along the outer surface of the umbrella-like sheltering toothbrush cover 22 and are used to denote each compartment of the toothbrush cover 22 thereby keeping consistent use of the various compartments for adults and children. The raised or indented symbols 50 and number 52 also help sight-disabled people. The node that is assigned for a child can be a number as shown on the node located in FIG. 5A. In cases where the child is too young to read, the raised or indented area could be any symbol such as a star, a triangle, a square or a circle as shown in FIG. 5. Although a symbol based embodiment is disclosed with reference to FIG. 5 and a number based embodiment is disclosed with reference to FIG. 5A, those skilled in the art will appreciate that numbers and symbols may be used alone or in combination depending upon the needs of particular users. It should also be appreciated that the different size compartments does not mean that one compartment is actually larger than the other but is simply to show a closer view of the node with denoting symbols.

With reference to FIGS. 6 through 9, an alternate embodiment of a toothbrush stand 100 in accordance with a preferred embodiment of the present invention is shown. The toothbrush stand 100 is shown with a toothbrush 118 being support thereby. The toothbrush stand 100 includes a base 112 shaped and dimensioned to rest upon a countertop or other horizontal support surface (not shown), an elongated upright support member 110 and an umbrella-like sheltering toothbrush cover 120. In accordance with a preferred embodiment of the present invention, the umbrella-like sheltering toothbrush cover 120 is composed of four cover members 122 shaped and dimensioned to mate in a manner defining a complete toothbrush cover 120 as discussed below in greater detail. Each cover member 122 defines a compartment 140 for placement of a toothbrush therein. As discussed below in greater detail, each cover member 122 is dimensioned to permit each of the respective cover members 122 to individually slide up and down with respect to one another.

The base 112 includes four arms 114 with a recess 116 in each arm 114. The respective recesses 116 are shaped and dimensioned to receive and support the distal end 118*a* of the handle of various size and type toothbrushes 118. Each arm 114 includes a downwardly depending leg 114*b*. The respective legs 114*b* raise the base 112 up off of the countertop or other support surface.

Extending upward from the base 112 is an elongated upright support member (or post) 110 having resting members 124 located on each side thereof. The resting members 124 extend outwardly from the exterior surface of the elongated upright support member 110 and the resting members 124 function to support the toothbrush 118 below the head end 118*b* thereof and spaced away from the elongated upright support member 110. In accordance with a preferred embodiment, and with reference to FIG. 9, the resting members 124 include an outwardly facing concave surface 142 shaped and dimensioned to receive and support the handle of a toothbrush 118. The outwardly facing concave surface 142 is coupled to the elongated upright support member 110 by an outwardly extending shaft 144. As shown with reference to a preferred embodiment, the elongated upright support member 110 is square in cross-section, but it is contemplated the elongated upright support member 110 may have various cross-sectional designs.

Figure 7:
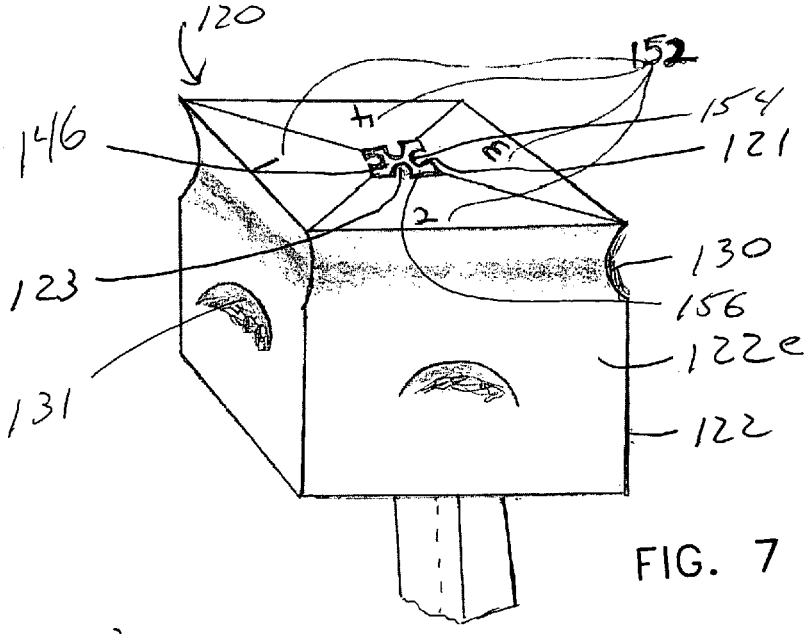
FIG. 7 is a detailed top perspective view of the toothbrush cover in as shown with reference to the embodiment of FIG. 6.
Figure 8:
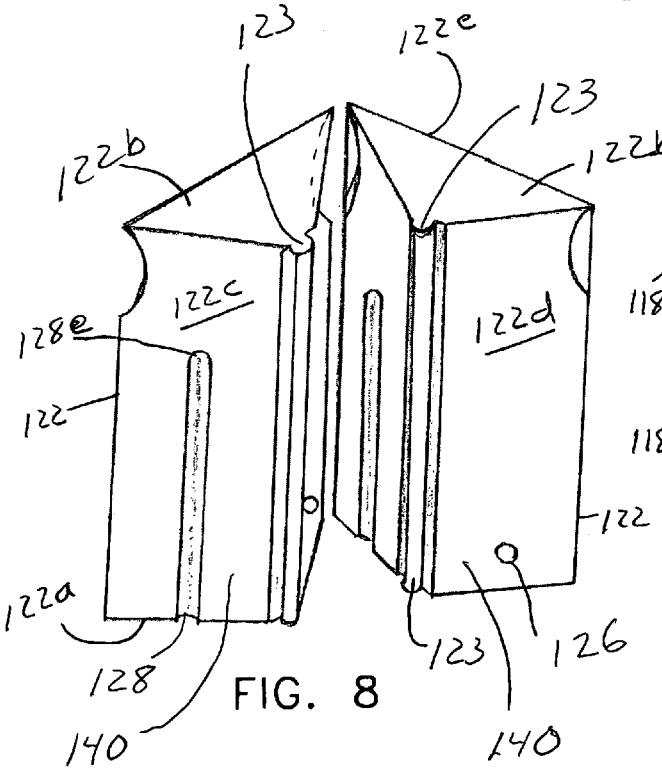
FIG. 8 is a detailed view of two adjacent compartments of the embodiment shown with reference to FIG. 6. The detailed view shows the cooperating slots and raised tabs of the compartments.
Figure 9:
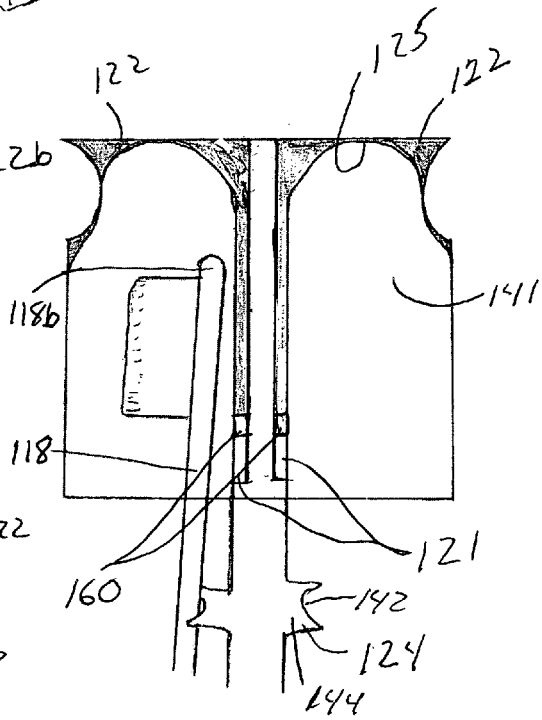
FIG. 9 is a cross-sectional view of the interior of the toothbrush cover of the embodiment as shown with reference to FIG. 6.

As best seen in FIGS. 7 and 9, the upper end 146 of the elongated upright support member 110 includes slots 121 in each side thereof. In accordance with a preferred embodiment of the present invention, four slots 121 shaped and dimensioned for receiving the keys 123 of the cover members 122 are provided along the sides of the elongated upright support member 110. The slots 121 function to receive and hold keys 123 extending from the cover members 122. More particularly, and in accordance with a preferred embodiment of the present invention, each slot 121 is in the form of a C-shaped recess formed along a side of the elongated upright support member 110. Since the upper end 154 of each slot 121 extends to the tip 156 of the upper end 146 of the elongated upright support member 110, the upper end 154 of each slot 121 is open such that a similarly shaped key 123 (but slightly smaller than the slot) extending from a cover member 122 may be slipped within the slot 121 and the cover member 122 may be slid downwardly along the elongated upright support member 110 with the key 123 securely held within the slot 121. In this way, the individual cover members 122 are able to slide up and down the elongated upright support member 110 permitting access to the head end 118*b* of a toothbrush 118 held therein. As shown with reference to FIGS. 7, 8 and 9 in accordance with a preferred embodiment of the present invention, the keys 123 are curved and thus it is preferred that the slots 121 are curved to correspond to the dimension of the keys 123 creating friction therebetween, while allowing the cover members 122 to move up and down via manual pressure.

FIG. 8 shows a pair of individual cover member 122 with each cover member 122 forming a generally triangular compartment 140 shaped and dimensioned for positioning of the head end 118*b* of a toothbrush 118 therein. Each cover member 122 has a closed top 122*b* and an open bottom 122*a*. Further extending downward from the closed top 122*b*, each cover member 122 includes a first cooperating wall 122*c* with a channel 128 formed therein, a second cooperating wall 122*d* with a raised tab 126 formed thereon and an opaque exterior wall 122*e* connecting the cooperating walls 122*c* and 122*d*. The four cover members 122 cooperate to form an umbrella-like sheltering toothbrush cover 120 with each cover member 122 aligned above a respective arm 114 of the opposed base 112.

As seen in FIG. 9 the interior compartment 141 of each cover member 122 is hollow and includes a curved upper interior surface 125 to allow for ease of cleaning.

Again with reference to FIG. 8, each channel 128 cooperates with a corresponding raised tab 126 in an adjacent cover member 122, that is, each raised tab 126 functions to slide within a corresponding channel 128. However, since the respective channels 128 do not run the entire length of the first cooperating wall 122*c*, the adjacent cover member 122 when lifted to remove or insert a toothbrush 118 will rise until the raised tab 126 reaches the end 128*e* of the respective channel 128. Thereafter, a user will encounter additional resistances indicating the cover member 122 has been raised to its desired extent. If however, a user desires to disassemble the present toothbrush stand 100 for cleaning they can continue to apply upward pressure thereby removing all of the cover members 122 from the elongated upright support member 110.

With reference to FIG. 7, the umbrella-like sheltering toothbrush cover 120 is shown as being formed from four individual cover member 122 which slide up and down in respective slots 121 via keys 123 in the manner discussed above. Each cover member 122 includes indicia 152 distinguishing one compartment from another. Further, each cover member may include gripping recesses 130 and 131, which can be rubber coated to aid users with wet hands.

Figure 6:
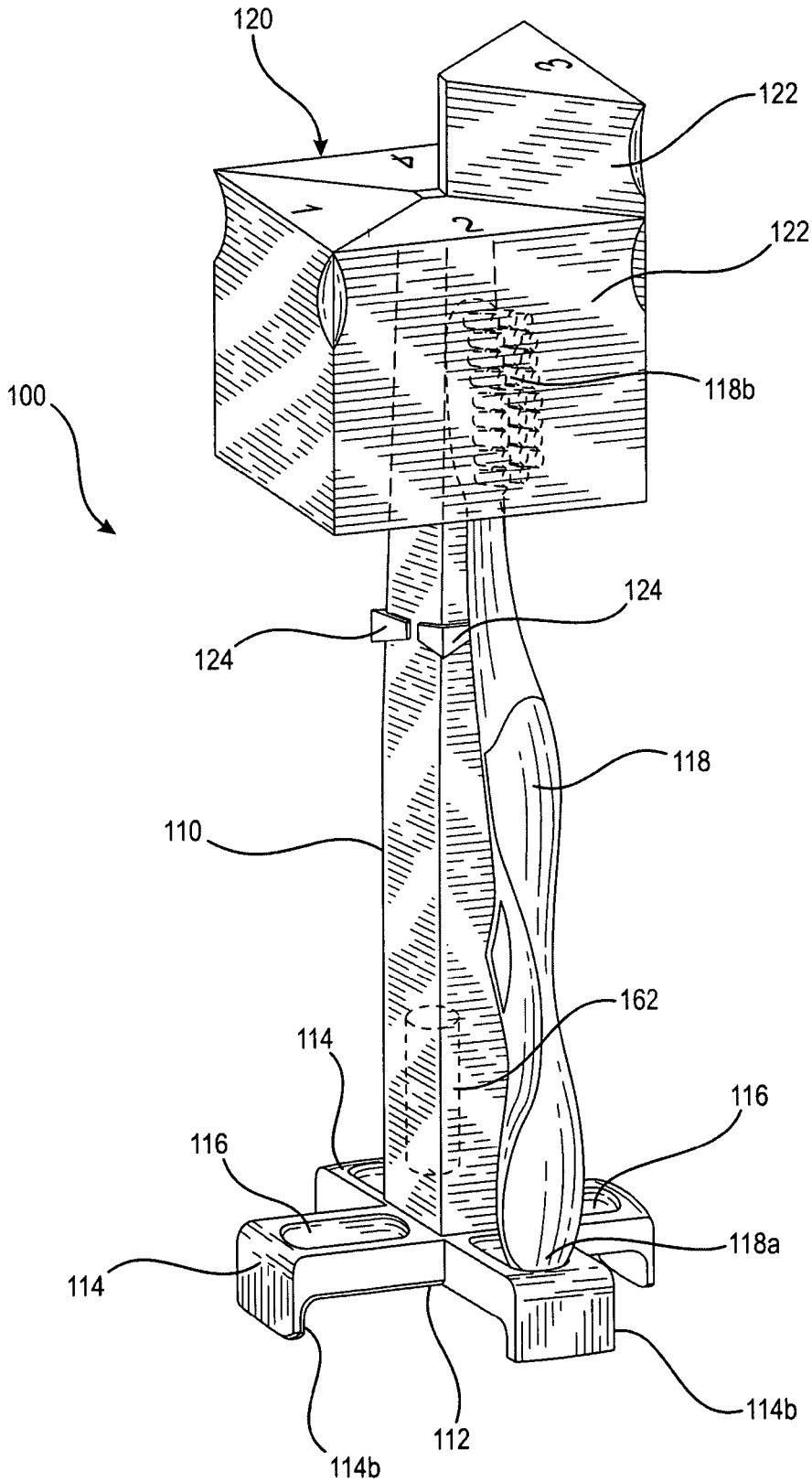
FIG. 6 is a perspective view of an alternate embodiment of the present toothbrush stand.

With reference to FIGS. 6 and 9, switches 160 are shown in slots 121 and an electronic sound or illumination device 162 is shown in the elongated upright support member 110. The switches 160 are activated when an individual cover member 122 is raised. Once activated, a signal either wirelessly or wired is sent to electronic device 162 to turn the device on. The electronic device will remain on for a predetermined period of time or until the cover member 122 is lowered to deactivate the respective switch 160.

In operation, a user would lift a cover member 122 similar to that shown in FIG. 6 wherein the cover member 122 with indicia "3" has been lifted waiting for placement of their toothbrush 118. Next, the user places their used toothbrush 118, distal end first, in recess 116 and rest the toothbrush handle up against the resting member 124. Once the toothbrush 118 is properly positioned, the user applies pressure to the top of the cover member 122 (or simply release the cover member 122) lowering the cover member 122 down over the head end 118*b* of the toothbrush 118 as shown with regard to toothbrush 118 contained within node marked with indicia "2".

The structure shown with regard to the present invention prevents brush-to-brush contact and allows one toothbrush to be removed while not exposing any of the other toothbrushes being held by the stand.

While the present invention has been shown and described with reference to certain exemplary embodiments thereof, it will be understood by those skilled in the art that various changes in form and details may be made therein without departing from the spirit and scope of the present invention as defined by the appended claims and their equivalents. Therefore, the scope of the invention is defined not by the detailed description of the invention but by the appended claims and their equivalents, and all differences within the scope will be construed as being included in the present invention.

The invention claimed is:

1. A toothbrush stand comprising:

(a) a base with a recess to support a distal end of a toothbrush thereon;

(b) an elongated upright support member extending from the base for leaning at least one toothbrush there-against near a head end of the toothbrush when the distal end is supported on the base;

(c) an umbrella-like sheltering toothbrush cover shaped and dimensioned and adapted to cover a head end of the toothbrush when the distal end of the toothbrush is supported on the base and the toothbrush is leaning against the elongated upright support member, wherein the toothbrush cover comprises:

(i) a plurality of four cover members defining individual compartments that slide up and down with respect to one another such that each cover member defines a compartment for a single toothbrush.

2. A toothbrush stand according to claim 1, wherein each cover member of the toothbrush cover has a channel on one wall thereof and a raised tab on another wall thereof.

3. A toothbrush stand according to claim 2, wherein a channel on one cover member cooperates with a tab on an adjacent cover member.

4. A toothbrush stand according to claim 2, wherein the elongated upright support member includes a slot which cooperates with a key extending from a cover member.

5. A toothbrush stand according to claim 4 wherein the elongated upright support member includes a plurality of slots which each respectively cooperate with a key extending from a cover member.

6. A toothbrush stand according to claim 1, wherein each cover member includes a curved gripping recess in an exterior wall thereof.

7. A toothbrush stand according to claim 1, wherein an interior upper surface of each cover member is curved for easy cleaning.

8. A toothbrush stand according to claim 1, wherein the elongated upright support member includes a resting member thereon to space the toothbrush handle from the support member.

9. A toothbrush stand according to claim 1, wherein each cover member includes indicating indicia thereon.

10. A toothbrush stand according to claim 1, wherein each cover member is generally triangular in cross-section.

11. A toothbrush stand according to claim 1, wherein each cover member is shaped and dimensioned so as to completely cover the head end of a toothbrush contained therein.

12. A toothbrush stand comprising:

(a) a base with a recess to support a distal end of a toothbrush thereon;

(b) an elongated upright support member extending from the base for leaning at least one toothbrush there-against near a head end of the toothbrush when the distal end is supported on the base;

(c) an umbrella-like sheltering toothbrush cover shaped and dimensioned and adapted to cover a head end of the toothbrush when the distal end of the toothbrush is supported on the base and the toothbrush is leaning against the elongated upright support member, wherein the toothbrush cover comprises:

(i) a plurality of four cover members defining individual compartments that slide up and down with respect to one another; and (d) a slot in the elongated upright support member which cooperates with a key extending from a cover member.

13. A toothbrush stand according to claim 12, including a switch and electronic device which are activated when at least one of the plurality of four cover members is raised.

14. A toothbrush stand comprising:

(a) a base with a recess to support a distal end of a toothbrush thereon;

(b) an elongated upright support member extending from the base for leaning at least one toothbrush there-against near a head end of the toothbrush when the distal end is supported on the base;

(c) an umbrella-like sheltering toothbrush cover shaped and dimensioned and adapted to cover a head end of the toothbrush when the distal end of the toothbrush is supported on the base and the toothbrush is leaning against the elongated upright support member, wherein the toothbrush cover comprises:

(i) a plurality of four cover members defining individual compartments that slide up and down with respect to one another; and (d) a switch and electronic device which are activated when at least one of the plurality of four cover members is raised.

* * * * *